United States Patent [19]

Koboshi et al.

[11] Patent Number: 4,797,352

[45] Date of Patent: Jan. 10, 1989

[54] METHOD OF PROCESSING A SILVER HALIDE PHOTOGRAPHIC LIGHT-SENSITIVE MATERIAL

[75] Inventors: Shigeharu Koboshi; Masayuki Kurematsu, both of Hino, Japan

[73] Assignee: Konishiroku Photo Industry Co., Ltd., Tokyo, Japan

[21] Appl. No.: 878,390

[22] Filed: Jun. 19, 1986

Related U.S. Application Data

[63] Continuation of Ser. No. 739,378, May 30, 1985, abandoned.

[30] Foreign Application Priority Data

Jun. 8, 1984 [JP] Japan ..... 59-116672

[51] Int. Cl.[4] ..... G03C 5/38; G03C 7/42

[52] U.S. Cl. ..... 430/421; 430/372; 430/398; 430/428; 430/429; 430/432; 430/455; 430/459; 430/463

[58] Field of Search ..... 430/398, 372, 421, 428, 430/429, 432, 463, 455, 459

[56] References Cited

U.S. PATENT DOCUMENTS

| | | | |
|---|---|---|---|
| 2,487,569 | 11/1949 | Mackey | 430/432 |
| 3,093,479 | 6/1963 | Olivares et al. | 430/372 |
| 3,287,127 | 11/1966 | Dershowitz | 430/372 |
| 3,615,510 | 10/1971 | Yodelson et al. | 430/455 |
| 3,801,322 | 4/1974 | Shirasu et al. | 430/372 |
| 3,819,374 | 6/1974 | Kemp | 430/432 |

*Primary Examiner*—Richard C. Schilling
*Attorney, Agent, or Firm*—Jordan B. Bierman

[57] ABSTRACT

A method of processing an imagewise exposed silver halide photographic light-sensitive material characterized in that said material is developed and then processed with a first liquid capable of fixing and is, in succession, processed with a second liquid capable of stabilizing, without applying any intervening washing step, and containing at least one of the following compounds:

(A) a guanidine compound represented by

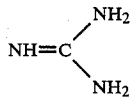

(B) a morpholine compound;

(C) a benzimidazole carbamate compound represented by 2-carbonyl-amino-benzimidazole;

(D) a quaternary onium salt compound;

(E) a triazine compound represented by the following Formula (1) or (2)

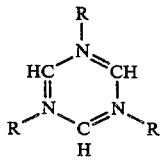

(1)

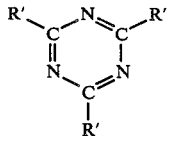

(2)

wherein R is an alkyl group and R′ is a halogen, amino group, alkyl group, or thioether group; or (F) an oxazolone compound containing at least one each of N, O, and C=O in the five-membered ring thereof;

and wherein a ratio of a volume of said first liquid to a volume of said second liquid is not less than 1/2,000.

7 Claims, No Drawings

METHOD OF PROCESSING A SILVER HALIDE PHOTOGRAPHIC LIGHT-SENSITIVE MATERIAL

This application is a continuation of application Ser. No. 739,378 filed 5-30-85 now abandoned.

FIELD OF THE INVENTION

This invention relates to a method of processing a silver halide photographic light-sensitive material and the processing liquid for use therein and more particularly to a method of processing the silver halide photographic light-sensitive material to be stabilized, in which the wash flow rate can be reduced in a washing step after a processing step where a thiosulfate is used, or precipitates can be controlled when a stabilizing process substituted for the washing step.

BACKGROUND OF THE INVENTION

Generally, a silver halide photographic light-sensitive material is processed in a series of steps of developing-fixing-washing or developing-bleaching-fixing-washing, after an imagewise exposure. Such a process as described above has recently been regarded as important from the viewpoints of the problems of environmental protection and water resources. Accordingly. there have been some proposals of how to reduce a large quantity of washing water used. For example, there are some well-known techniques of saving a quantity of washing water by making the flow backward through a multistage washing tank system, such as described in West German Patent No. 2,920,222 and S. R. Goldwasser, a technical literature titled Water Flow Rate in Immersion-washing of Motion Picture Film', Journal of SMPTE, No. 64, pp. 248–253, May 1955. In addition, there are descriptions of stabilizing processes in which washing steps are omitted, that is, any washing step is not taken substantially, in Japanese Patent Publication Open to Public Inspection (hereinafter called Japanese Patent O.P.I. Publication) Nos. 8543/1982, 14834/1983 and 134636/1983, and the like.

In the case that, after such a processing solution as a bleach-fix or fixing solution containing a thiosulfate is used, a large quantity of washing water is not used in the process, but a small quantity of washing water is used in a preliminary washing step or in a multistage counter-current washing step, or in the case that a stabilizing process is made while a small quantity of washing water is being replenished, processing liquids used in this process are stayed in for an extremely long time. It is therefore disadvantageous that minute black precipitates are apt to produce in the processing liquids due to the passage of a preservation time.

As for the methods of preventing the precipitates of a sulfide in a washing step with the purpose of overcoming such a disadvantage, there is such a technique as described in U.S. Pat. No. 4,059,446, for example, in which a polyalkylene oxide type non-ionic activtor is added into a washing bath, Further, there is such a technique as described in Japanese Patent O.P.I. publi-Cation No. 8542/1982 in which an isothiazoline compound or a benzisothiazoline compound is added into washing water.

Even if such non-ionic activator as described above is added into washing water or a processing liquid for stabilization, i.e., a stabilizer substituted for a washing water, there displays no effect on the prevention of the sulfide precipitates, and there is no more than only a little effect on the dispersion of the precipitates but further there is no practical applicability because bubbles are produced in the washing bath.

Meantime, isothiazoline or benzisothiazoline compounds can effectively prevent sludges produced of microorganisms, but cannot display a satisfactory effect against the production of the minute black precipitates.

SUMMARY OF THE INVENTION

Objects of the Invention

It is an object of this invention to provide a method of processing a silver halide photographic light-sensitive material, in which a washing flow rate can greatly be saved without producing any precipitates and affecting any photographic characteristics.

Another object of the invention is to provide a method of processing a silver halide photographic light-sensitive material, in which a washing step can be omitted if occasion demands and any precipitates and the like cannot be produced even when applying a stabilization process to the light-sensitive material as well as the safety can be assured.

A further object of this invention is to provide a method of processing a silver halide photographic light-sensitive material, in which an evaporative dry-curing process. an incinerating process and the like can effectively be used, which have not so far been usable because of a large waste quantity of washing water, and a perfectly pollution-free system of inexpensive costs can be applied.

After we devoted ourselves to the study, we found that the above-mentioned objects can be achieved in the manner that a silver halide photographic light-sensitive material is developed and is then processed with a processing liquid capable of fixing it and, in succession, processed with a processing liquid containing at least one kind of the following compounds. Thus, this invention has been brought to completion.

[Compounds]

(A) Guanidine compounds
(B) Morpholine compounds
(C) Benzimidazole carbamate compounds
(D) Quaternary onium salt compounds
(E) Triazine compounds represented by the following Formula;

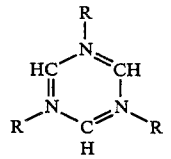

(1)

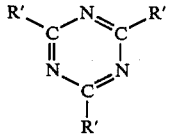

(2)

wherein, R is an alkyl group; and R′ is a halogen, an amino group, an alkyl group or a thioether group.

(F) Oxyzolone compounds

The compounds of the invention will now be described below.

The guanidine compounds are represented by

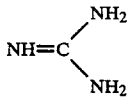

the derivatives thereof which include, for example, dodecylguanidine hydrochloride, polyhexamethyleneguanidine hydrochloride, guanidine carbonate, n-dodecyl-guanidine acetate, 1,17-diguanidine-9-azaheptadecane, p-benzoquinone-amidino-hydrazone-thiosemicarbazone, 1,6-di(4'-chlorophenyldiguanido)hexane and polyhexamethylenebiguanidine hydrochloride.

The merpholine compounds are morpholine and the derivatives thereof including, for example, 4-(2-nitrobutyl)morpholine, 4-(3-nitrilobutyl)morpholine, N-acetoacetylmorpholine, 2-(N-morpholino)ethanesulfonic acid sodium salt, N-β-hydroxyethylmorpholine, N-(2-aminoethyl)morpholine, N-(2-hydroxypropyl)-morpholine, N-(3-aminopropyl)morpholine, 4-morpholine-carboximido-guanidine, 2,6-dimethyl-4-tridecyltetrahydro-1,4-oxazine, and 4-cyclodecyl-2,6-dimethyltetrahydro-1,4-oxazine acetate.

The benzimidazole carbamate compounds are 2-carbonyl-amino-benzimidazole and the derivatives thereof including, for example, 2-(methoxy-carbonyl-amino)-benzimidazole, 1-(n-butylcarbamoyl)-2(methoxycarbonyl-amino)-benzimide and methyl-1-(butylcarbamoyl)-2-benzimidazole carbamate.

The quaternary onium salt compounds include, for example, a quaternary ammonium compound, a quaternary phosphonium compound, a quaternary arsonium compound, a quaternary stibonium compound, a quaternary oxonium compound, a quaternary sulfonium compound, a quaternary selenonium compound, a quaternary stannonium compound and a quaternary iodonium compound. Among these compounds, the quaternary ammonium compounds and the quaternary phosphonium compounds are preferable. Further, the quaternary ammonium compounds are represented by the following formulas:

[3]

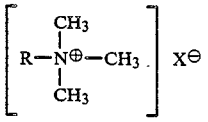

[4]

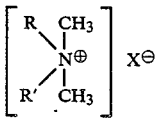

[5]

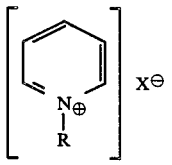

wherein each R and R' is an alkyl group having 8 to 18 carbon atoms; and X is a monovalent anion which is preferably a halogen.

The typical examples of the quaternary ammonium compounds each represented by the abovegiven formulas include cethyltrimethyl ammonium chloride, laurylpyridinium chloride, trimethyldodecyl ammonium chloride. trimethylcoconutalkyl ammonium chloride, methyl-bis-(2-hydroxyethyl)-cocount alkyl ammonium chloride, dioctyldimethyl ammonium chloride, didecyldimethyl ammonium chloride, dioctadecyldimethyl ammonium chloride, trioctylmethyl ammonium chloride, and tridodecylmethyl ammonium chloride.

The preferable quaternary phosphonium compounds include, for example, tri-n-butyltetradecyl phosphonium chloride, triphenylbenzyl phosphonium chloride, methy-ethyl-phenyl-benzyl chloride. and tri-n-butylbenzyl phosphonium.

The typical examples of the triazine compounds each represented by the Formula (1) or (2) of the invention include 2-thiomethyl-4-ethylamino-6-(1,2-dimethylpropylamino)-s-triazine, hexahydro-1,3,5-tris(2-hydroxyethyl)-s-triazine, hexahydro-1,3,5-tris(2-methyl)-s-triazine, 2,4-dichloro-6-o-chloro-anilino-s-triazine, and 1-[bis-dimethylaminophosphoryl]-3-amino-5-phenyl-1,2,4-triazine.

The oxazolone compounds are those containing at least one each of N, O and C=O in the five-membered ring thereof; and the typical examples thereof include isooxazolone, 4(2'-chlorophenyl-hydrozone)-3-methyl-5-isoxazolone, 5-(methylmercapto-methyl)-3-(5-nitro-2-furfurylidene-amino)-2-oxazolidinone, and 1-amino-3-isoxazolidone.

Among these compounds, (A) guanidine compounds and (B) morpholine compounds are preferred, and (A) guanidine compounds are most preferred.

In the invention, a processing step carried out with a processing liquid capable of fixing a silver halide photographic light-sensitive material means a step in which a fixing bath, a bleach-fix bath or the like is used for the purpose of fixing the light-sensitive material, and this processing step is normally carried out after the developing step.

The processing liquid capable of fixing will be described in more detail later.

In the invention, it may be allowed to carry out such a washing step as will be described below or to carry out a stabilizing process without applying any substantial washing step, provided that the light-sensitive material is processed in advance with the processing liquid capable of fixing it.

The term, a washing step, mentioned herein means a step with the purpose of washing out the ingredients of a fixer or bleach-fixer from the light-sensitive material, that is, a step in which a small quantity of washing water is used at a low rate of water-replacement. In the invention, the expression, 'a washing step in which a small quantity of washing water is used', means a washing step in which a volume of a fixer or bleach-fixer introduced into the forefront washing tank to a volume of washing liquid introduced thereinto is in a proportion of not less than 1/2,000. A rinse, auxiliary washing, chemical prewashing in a single stage or multistage countercurrent system may also be carried out for a very short time, provided that a concentration of the fixer or bleach-fixer is within the order of not less than 1/2,000 in the forefront processing tank. In a preferred example of the invention, it was successfully achieved to reduce a washing flow rate sharply in the process of a multistaged tank counter flow system using a very small quantity of washing water, in which the washing tank system was divided into a plurality of individual tanks into which the compounds of the invention were added. It is preferred to provide not less than two washing tanks in this washing step so that a washing flow rate may further be economized if such tanks are increased in number. It is also preferred to adopt what is called a counter-current system that washing water is made flow backward from the rear tank to the front tank. If a concentration of washing water in the rearmost tank is about the same as or not more than a dilution rate of a fixing or bleach-fixing bath when continuously processing at a washing flow rate, the photographic characteristics may be regarded to be equivalent, and the washing flow rate may be determined according to the method described in the aforementioned technical literature reported by S. R. Goldwasser.

The stabilizing process in the invention means a process in which a stabilizing step is carried out without substantially applying any washing step immediately after completing a process with the use of a processing liquid capable of fixing. A processing liquid for the above-mentioned stabilization is called a stabilizer, and the processing tank thereof is called a stabilizing tank or a stabilizing bath.

In this invention, a stabilizing process may be performed in a single tank, and desirably in two or three tanks. However it is preferred to use not more than nine tanks at most. In other words, if a replenishing quantity is the same, the more tanks are provided, the lower the concentration of contamination is in the rearmost stabilizing bath. However, when increasing the tanks in number, the aggregate quantity of liquid in tanks will increase, so that a rate of replacing the liquid in the tanks by a replenishing liquid may be lowered and the stabilizing liquid is stayed in for an extremely long time. Such a prolonged staying time is not desirable because the preservability of the liquid will be deteriorated and a precipitation will also be accelerated to produce.

It may be said that the same things will be happened in the aforementioned washing step using a small quantity of washing water, i.e., a multistage counter-current washing process.

Hereinafter, every processing liquid to which a compound of the invention is added, that is, every processing liquid to be used in a processing step following a process capable of fixing will be referred to as 'a stabilizer', and the processing step next to a processing step capable of fixing will be referred to as 'a stabilizing step'.

In this invention, the expression, 'a stabilizing process is carried out without substantially applying any washing step', means that such process is carried out wherein the proportion of a quantity of a fixing liquid or bleach-fixing liquid brought into the forefront stabilizing tank to a quantity of a stabilizing liquid is not less than 1/2,000. It may be allowed to carry out a very short rinse, auxiliary washing. acceleratory washing processes and the like through a single or multiple tank counter-current system, provided that in the forefront stabilizing tank the concentration of a fixing liquid or a bleaching-fixing liquid is of the order of not less than 1/2,000.

It is preferred to use a compound of the invention within a range of 0.0005 g to 10 g per liter of a stabilizing liquid, and more preferably from 0.005 g to 2 g to obtain an excellent result. In addition, any of the compounds of the invention may also be used in combination.

Generally, when a concentration of silver ions in a stabilizing liquid is not less than 20 mg per liter of the stabilizing liquid, black precipitates are apt to produce, and if not more than the above degree, it is negligible even if they are produced. In the case of using a compound of the invention, a substantially great effect may be obtained by making it present in a stabilizing liquid (in a tank) in which a concentration of a fixing agent and particularly a thiosulfate is within the above-mentioned range. Even if the compound of the invention is added into a processing liquid having a concentration of not more than the above-mentioned degree nothing affects any photographic characteristics at all. Therefore, how to add the compounds of the invention is freely selectable. Namely, the compounds of the invention may be added into the stabilizing liquid directly, or into a replenishing liquid for the stabilizing liquid, and besides the above, it is also allowed to use such a manner that the compounds of the invention are added into a prebath to make adhere to a light-sensitive material and are then brought into the stabilizing liquid.

In the invention, a preferable pH value of stabilizing liquids is within the range between 2.0 and 10, and it is particularly preferred to adjust the pH value to the range of from 3.0 to 8.0 from the viewpoint of the stability in an image preservation.

The stabilizing liquids added with the compounds of the invention may contain, for the purpose of improving the stability of an image preservation, with chelating agents such as a polyphosphate, an aminopolycarboxylic acid salt, a phosphonocarboxylic acid salt, an aminophosphonate and the like; organic acid salts such as citric acid, acetic acid, succinic acid, oxalic acid, benzoic acid, and the like; pH adjusting agents such as a sulfite, a phosphate, a borate, chloric acid, sulfuric acid and the like; antimold agents such as a phenol derivative, a catechol derivative, an imidazole derivative, a triazole derivative, a thiapentazole derivative, an organic halogen compound, an antimold agent well-known as a slime-controlling agent useful in paper-pulp industries and the like; optical brightening agents; surface active agents; antiseptic agents; organic sulfur compounds; onium salts; formalins; and the like.

The preferred chelating agents including a polyphosphate, an aminopolycarboxylic acid salt, an oxycarboxylic acid salt, a polyhydroxy compound, an organic phosphate and the like may be used, and in particular, an aminopolycarboxylic acid salt and an organic phosphate may be able to give an excellent result when they are used in the invention.

The following chelating agents may be given as the typical examples and it is, however, to be understood that the invention shall not be limited thereto.

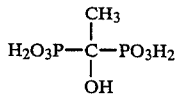
(1)

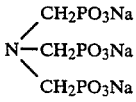
(2)

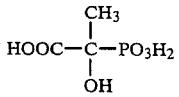
(3)

-continued

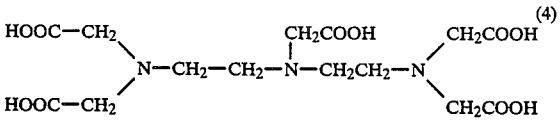
(4)

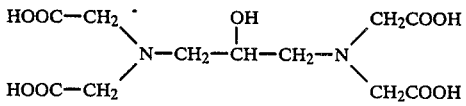
(5)

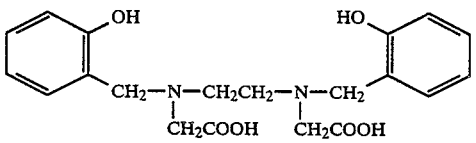
(6)

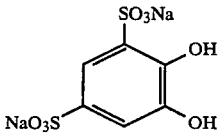
(7)

There can be used a chelating agent in the amount of from 0.05 g to 40 g and preferably from 0.1 g to 20 g per liter of a stabilizing liquid.

Next, the stabilizing liquids to be used in the invention are preferably to contain a metallic salt. Such metallic salts include, for example, Ba, Ca, Ce, Co, In, La, Mn, Ni, Pb, Sn, Zn, Ti, Zr, Mg, Al, Sr and the like. They may be supplied in the form of such an inorganic salt as a halide, hydroxide, sulfate, carbonate, phosphate, acetate and the like or a water-soluble chelating agent. Such metallic salts may be added in the amount within the range of from $1\times10^{-4}$ mol to $1\times10^{-1}$ mol, and more preferably from $4\times10^{-4}$ mol to $2\times10^{-2}$ mol, and further preferably from $8\times10^{-4}$ mol to $1\times10^{-2}$ mol per liter of a stabilizing liquid.

Those to be added to the stabilizing liquids of the invention, besides the above-mentioned compounds, include an optical brightening agent, an organic sulfuric compound, an onium salt, and a hardening agent and, in addition, a polyvinyl pyrrolidone such as PVP K-15, Rubiscole K-17 and the like.

There is a compound particularly desirable to be added to a stabilizing liquid containing a compound of the invention, that is an ammonium compound which may be supplied in the form of the ammonium salts of various inorganic compounds. Typical examples of such ammonium salts are given as follows; ammonium hydroxide, ammonium bromide, ammonium carbonate, ammonium chloride, ammonium hypophosphite, ammonium phosphate, ammonium phosphite, ammonium fluoride, acidic ammonium fluoride, ammonium fluoroborate, ammonium arsenate, ammonium hydrogencarbonate, ammonium hydrogenfluoride, ammonium hydrogensulfate, ammonium sulfate, ammonium iodide, ammonium nitrate, ammonium pentaborate, ammonium acetate, ammonium adipate, ammonium aurintricarboxylate, ammonium benzoate, ammonium carbamate, ammonium citrate, ammonium diethylthiocarbamate, ammonium formate, ammonium hydrogenmalate, ammonium hydrogenoxalate, ammonium hydrogenphthalate, ammonium hydrogentartrate, ammonium lactate, ammonium malate, ammonium maleate, ammonium oxalate, ammonium phthalate. ammonium picrate, ammonium pyrrolidinedithiocarbamate, ammonium salicylate, ammonium succinate, ammonium sulfanilate, ammonium tartrate, ammonium thioglycolate, 2,4,6-trinitrophenol ammonium and the like.

These ammonium compounds may be added in an amount within the range of from 0.05 g to 100 g and preferably from 0.1 g to 20 g per liter of a stabilizing liquid.

The temperatures for a stabilizing process are in the range between 15° C. and 60° C., and preferably between 20° C. and 33° C. The shorter a processing time is, the better from the viewpoint of rapid processing requirements, and it is normally from 20 seconds to 10 minutes and most preferably from 30 seconds to 5 minutes. In the case of a multistage stabilizing process, it is preferred to process every preceding stage in a shorter time than to process the succeeding stages. It is particularly preferred to process one stage after another respectively in every 20% to 50% longer time. It is preferred to provide a counter-current system in which a stabilizing process is of a multistage system and a replenishing liquid is supplied to the rearmost tank so as to make an overflow from the rearmost up to the foremost tank successively. It is the matter of course that a single tank system can also be allowed to use.

In the invention, a fixing step is carried out in a processing bath containing a soluble complex-forming agent, i.e., a fixing agent, capable of solubilizing a silver halide into a silver halide complex, and the fixing agents include not only the ordinary type fixing liquids but also bleach-fixing liquids, monobath type combined developing-fixing liquids, and monobath type developing-bleaching-fixing liquids.

The above-mentioned fixing agents include a thiosulfate, a thiocyanate, an iodide, a bromide, a thioether, a thiourea, and the preferred fixing agent in the invention is a thiosulfate. And the particularly preferred one is an ammonium thiosulfate.

It is allowed to make a rinse or the like at will, provided that a stabilizing process of the invention is completed in advance. It is also preferred to use a processing liquid containing a surface active agent to serve as a water-draining liquid in the final bath.

Metal complexes of an organic acid capable of serving as bleaching agent to be used in a bleaching-fixing liquid or a bleaching liquid are those coordinated ions of a metal such as iron, cobalt, copper or the like with an organic acid such as an aminopolycarboxylic acid, oxalic acid, citric acid or the like. A polycarboxylic acid or an aminopolycarboxylic acid is given as the example of the most preferable organic acids used for forming the metal complexes of such organic acids. These polycarboxylic acids or aminopolycarboxylic acids may be an alkaline metal salt, an ammonium salt, or a water-soluble amine salt. The typical examples thereof may include;

[1] Ethylenediamine tetraacetic acid,
[2] Diethylenetriamine pentaacetic acid,
[3] Ethylenediamine-N-(β-oxyethyl)-N,N',N'-triacetic acid,
[4] Propylenediamine tetraacetic acid,
[5] Nitrilotriacetic acid,
[6] Cyclohexanediamine tetraacetic acid,
[7] Iminodiacetic acid,
[8] Hydroxyethylglycine citric acid (or tartaric acid),
[9] Ethyletherdiamine tetraacetic acid,
[10] Glycoletherdiamine tetraacetic acid,
[11] Ethylenediamine tetrapropionic acid,

[12] Phenylenediamine tetraacetic acid,
[13] Disodium ethylenediamine tetraacetate,
[14] Ethylenediaminetetraacetic acid tetratrimethyl ammonium salt,
[15] Ethylenediaminetetraacetic acid tetrasodium salt,
[16] Diethylenetriaminepentaacetic acid tetrasodium salt,
[17] Ethylenediamine-N-(β-oxyethyl)-N,N',N'-triacetic acid sodium salt,
[18] Propylenediaminetetraacetic acid sodium salt,
[19] Nitriloacetic acid sodium salt, and
[20] Cyclohexanediaminetetraacetic acid sodium salt.

These bleaching agents are used in the amount of from 5 g to 450 g per liter, and more preferably from 20 g to 250 g per liter.

The bleaching-fixing liquids used therein contain the metal complexes of such organic acids as mentioned above to serve as the bleaching agents thereof and may also contain a variety of additives. It is particularly preferred that the bleaching-fixing liquids contain such a rehalogenating agent as an alkali halide or an ammonium halide including, for example, potassium bromide, sodium bromide, sodium chloride, ammonium bromide and the like, such a metallic salt as mentioned above, and a chelating agent, to serve as the additives. It is also allowed to add thereto suitably with such a pH buffer as a borate, an acetate, a carbonate, a phosphate and the like, and those well-known to be added in an ordinary bleaching liquid, such as an alkylamine, a polyethylene oxide and the like.

In addition to the above, the fixing liquids and bleaching-fixing liquids each may contain a single or a plurality of pH buffers comprising a sulfite such as ammonium sulfite, potassium sulfite, ammonium bisulfite, potassium bisulfite, sodium bisulfite, ammonium metabisulfite, potassium metabisulfite, sodium metabisulfite and the like, or a variety of salts such as boric acid, borax, sodium hydroxide, potassium hydroxide, sodium carbonate, potassium carbonate, sodium bicarbonate, potassium bicarbonate, acetic acid, sodium acetate, ammonium hydroxide and the like.

With the purpose of increasing the activity of a bleaching-fixing liquid in the invention, air or oxygen may be blown, if required, into a bleaching-fixing bath and a reservoir tank of a bleaching-fixing replenishing liquid, or such a suitable oxidizing agent as hydrogen peroxide, a bromate, a persulfate may suitably be added therein.

In the processes of the invention, silver may be recovered, in a variety of methods, not only from a stabilizing liquid but also from a processing liquid containing soluble silver salts, such as a fixing liquid, a bleaching-fixing liquid and the like. For example, there may effectively use an electrolysis method such as described in French Patent No. 2,299,667; a precipitation method such as described in Japanese Patent O.P.I. Publication No. 73037/1977 and W. German Patent No. 2,331,220; an ion-exchange method such as described in Japanese Patent O.P.I. Publication No. 17114/1976 and W. German Patent No. 2,548,237; a transmetallation method such as described in British Patent No. 1,353,805; and the like. Further, in a silver recovery, it is allowed to use a method in which the overflow of a processing liquid is collected to recover silver from the aforementioned soluble silver salts in the liquid and the remaining liquid is discarded as a waste, or another method in which a regenerating agent is added to reuse the remaining liquid as a replenishing liquid or a tank-processing liquid. It is particularly preferred to recover silver after mixing up a stabilizing liquid with a fixing liquid or a bleaching-fixing liquid.

In the case that a bleaching-fixing step of the invention is followed directly by a stabilizing step without interposing any substantial washing step, it is allowed to provide a short-time silver recovery step or a rinse step using stagnant water between the bleaching-fixing bath and the stabilizing bath. It is also allowed to provide a water-drain bath containing a surface active agent after the stabilizing bath, however, it is preferred not to provide any silver recovery, rinse and water-drain baths and the like. These additional processes may also be carried out in a spray or coatng process.

In the invention, a process may also be carried out by keeping the stabilizing liquid in contact with ion-exchange resin. This means that ion-exchange resin put in a cloth-bag is brought into direct contact with a stabilizing tank in which a light-sensitive material is being processed, or that the ion-exchange resin put in a chemical-fiber bag is brought into contact with the stabilizing liquid in a resin column or a filter case directly connected to the stabilizing tank. If the overflow of a stabilizing liquid of the invention is brought into contact with ion-exchange resin, at least a portion of the overflow can be reused as the stabilizing liquid. This means that the stabilizing liquid is taken out of the stabilizing tank to separate each other, and the liquid taken out is brought into contact with ion-exchange resin in a column method or a mixture method, and then at least a portion thereof is put into the stabilizing tank. The expression, 'be put into the stabilization tank', means that the portion thereof may be put into to serve as a replenishing liquid, and that it is, however, preferable to return the liquid to the stabilizing tank again without relating to the replenishment system after an ion-exchange process is carried out in a circulation system. If a stabilizing bath is multistaged, ion-exchange resin may be brought into contact with a stabilizing liquid in any stage. It is however preferable to do in the stage immediately after completing a bleaching-fixing process, and more preferably in two or more stages and further preferably in every stage of the stabilizing bath.

A preferable embodiment in the case that a stabilizing bath comprises a single stabilizing tank is that in which ion-exchange resin is put in a resin column connected directly to the stabilizing tank so as to bring the resin into contact with the stabilizing liquid. A preferable embodiment in the case that a stabilizing bath comprises two units of tanks is that in which ion-exchange resin is put in a resin column or a filter case which is directly connected to the first tank immediately after a bleaching-fixing process so as to bring the resin into contact with the stabilizing liquid, and more preferably to bring it into contact similarly with the liquid in the second tank. A preferable embodiment in the case of three or more tanks used in a stabilizing bath is that in which such a contact therewith is to be made as mentioned above by directly connecting to the first tank immediately after the bleaching-fixing process, and a further preferable embodiment is to bring the resin into contact with the stabilizing liquid directly in each tank other than the first tank. As mentioned above, it is most preferable to bring ion-exchange resin into contact with a stabilizing liquid by directly connecting to a stabilizing tank. However, if there is no space to provide a resin column or a filter case in an automatic processing apparatus, it is possible to bring ion-exchange resin into contact with a stabilizing liquid which is taken out forcibly from a stabilizing tank by such a way of increasing an overflow or replenishment, so as to return the resulting liquid to the stabilizing bath. In the case of using a single tank, a stabilizing liquid taken out therefrom is brought into contact with ion-exchange resin by making use of a resin column and the stabilizing liquid is then returned to the stabilizing tank. In this case, it is preferred to add the ingredients of the stabilizing liquid in contact with the ion-exchange resin. In the case of using two or more tanks in a stabilizing bath, ion-exchange resin is brought into contact with an overflow from the forefront tank close to a bleaching-fixing step by making use of a resin column and is then returned to a stabilizing tank more closer to the side of a drying step. In this case, it is desired to add the ingredients of the stabilizing liquid and then to return to the tank. Though it is possible to reuse the stabilizing liquid which was brought into contact with the ion-exchange resin to serve as a replenishing liquid, it is desired to add the ingredients of the stabilizing liquid, in this case.

It is preferred that the above-mentioned ion-exchange resin is brought into contact with the stabilizing liquid and is then brought into contact with a bleaching-fixing liquid and thereafter it is regenerated. It is particularly possible in the case of using an anion-exchange resin to recover silver through a process of regenerating the resin, and the effects thereof are substantially great.

The foregoing are the description of the case that a stabilizing liquid is brought into contact with ion-exchange resin, and the invention shall not be limited thereto, but an electrodialysis process, a back permeation process and the like may be used in the invention. About the former process, refer to Japanese Patent Application No. 96352/1984 and about the latter, refer to Japanese Patent Application No. 96350/1984.

In the invention, any ordinary developing processes may be adopted without special limitation to serve as a developing process to be carried out prior to a process in which a processing liquid having a fixing capability is used. In the case that a light-sensitive material is for color-photography, a color developing step is carried out. Such a color developing step means that a color-image is formed in this step, and more concretely that a color-image is formed by a coupling reaction of the oxidation products of a color developing agent with color couplers.

Next, the color developing step will be described. In this step, it is usually required to contain a color developing agent into a color developing liquid. This requirement includes that a color developing agent is incorporated in a color photographic light-sensitive material and the light-sensitive material is processed with a color developing liquid or an alkaline liquid, i.e., an activator liquid containing a color developing agent.

The color developing agents to be incorporated in color developing liquids are aromatic primary amine color developing agents including aminophenol or p-phenylenediamine derivatives. These color developing agents may be used in the form of an organic acid salt or an inorganic acid salt. For example, there may be used a chloride, a sulfate, a phosphate, a p-toluenesulfonate, a sulfite, an oxalate, a benzenedisulfonate and the like.

These compounds are generally used in terms of the concentration of from about 0.1 g to about 30 g per liter of a color developing liquid used, and more preferably from about 1 g to 15 g per liter. If the amount added is not more than 0.1 g per liter, any satisfactory color density will not be obtainable.

To carry out such process, the temperature of processing liquid in a color developing tank is from 10° C. to 65° C. and more preferably from 25° C. to 45° C.

The above-mentioned aminophenol developing agents include, for example, o-aminophenol, p-aminophenol, 5-amino-2-oxytoluene, 2-amino-3-oxy-toluene, 2-oxy-3-amino-1,4-dimethylbenzene and the like.

A particularly useful aromatic primary amine color developing agent is an N,N'-dialkyl-p-phenylenediamine compound in which the alkyl and phenyl groups thereof may be substituted or unsubstituted. Among those, the particularly useful compounds include, for example, an N,N'-dimethyl-p-phenylenediamine chloride, an N-methyl-p-phenylenediamine chloride, an N,N'-dimethyl-p-phenylenediamine chloride, a 2-amino-5-(N-ethyl-N-dodecylamino)-toluene, an N-ethyl-N-$\beta$-methanesulfonamidoethyl-3-methyl-4-aminoaniline sulfate, an N-ethyl-N-$\beta$-hydoxyethylaminoaniline, a 4-amino-3-methyl-N,N'-diethylaniline, a 4-amino-N-(2-methoxyethyl)-N-ethyl-3-methylaniline-p-toluene sulfonate, and the like.

The above-mentioned color developing agents may be used individually or in combination. In addition, the above-mentioned color developing agents may be incorporated in a color photographic material. For example, there may be used a procedure in which a color developing agent is incorporated in the form of a metal salt, such as described in U.S. Pat. No. 3,719,492; a procedure in which a color developing agent is incorporated in the form of a Shiff base, such as described in U.S. Pat. No. 3,342,559 and Research Disclosure, No. 15159, 1976; a procedure in which a color developing agent is incorporated in the form of a dye precursor, such as described in Japanese Patent O.P.I. Publication Nos. 65429/1983 and 24137/1983 and the like; a procedure in which a color developing agent is incorporated in the form of a color developing agent precursor, such as described in U.S. Pat. No. 3,342,597; and the like. In this case, a silver halide color photographic light-sensitive material may be processed with an alkaline liquid, that is, an activator liquid, in place of a color developing liquid, and at this time a bleaching-fixing process is carried out immediately after processing with the alkaline liquid.

Such color developing liquids may contain an alkaline agent popularly used in a developing liquid, including, for example, sodium hydroxide, potassium hydroxide, ammonium hydroxide, sodium carbonate, potassium carbonate, sodium sulfate, sodium metaborate, borax, or the like, and, in addition, it may be allowed to contain a variety of additives including, for example, benzyl alcohol, a halogenated alkali metal such as potassium bromide, potassium chloride or the like, or a development controlling agent such as citrazinic acid or the like, and a preserving agent such as hydroxyamine, a sulfite and the like. In addition, there may suitably be incorporated with a variety of anti-foaming agents and surface active agents, as well as an organic solvent such as methanol, dimethylformamide, dimethylsulfoxide, or the like.

The pH values of such color developing liquids are normally not lower than 7 and preferably from about 9 to 13.

The color developing liquids used in the invention may contain if occasion demands such an oxidation inhibitor as diethylhydroxyamine, tetronic acid, tetronimide, 2-anilinoethanol, dihydroxyacetone, an aromatic secondary alcohol, hydroxamic acid, pentose or hexose, pyrogallol-1,3-dimethyl ether, or the like.

In the color developing liquids used in the invention, various chelating agents may be used jointly to serve as a metal-ion chelating agent. Such chelating agents include, for example, an aminepolycarboxylic acid such as ethylenediaminetetraacetic acid, diethylenetriaminepentaacetic acid or the like; an organic phosphonic acid such as 1-hydroxyethylidene-1,1-diphosphonic acid or the like; an aminopolyphosphonic acid such as aminotrimethylenephosphonic acid or ethylenediamine tetraphosphonic acid or the like; an oxycarboxylic acid such as citric acid, gluconic acid or the like; a phosphonocarboxylic acid such as 2-phosphonobutane-1,2,4-tricarboxylic acid or the like; a polyphosphoric acid such as tripolyphosphoric acid, hexametaphosphoric acid or the like; a polyhydroxy compound; and the like.

A conditioning tank may be provided after the above-mentioned color developing process. The conditioning tank will serve for stopping a development, accelerating a bleaching reaction, preventing a developing liquid from mixing into a bleaching liquid and lessening the bad influence of the wrong mixture. Such a conditioning bath contains, for example, a bleach-accelerator and a buffer. As for the bleach-accelerators, an organic sulfur compound is generally used, and a mercapto compound or a thion compound is also used. In addition, an acid or an alkaline agent such as acetic acid, citric acid, succinic acid, sulfuric acid, sodium hydroxide or the like is also used for adjusting the pH values of conditioners. These bleach-accelerators and buffers are used in the amount added within a range of from 0.001 g to 100 g per liter of conditioner used.

Besides the above-mentioned additives, chelating agents and the like may also be added therein.

As for the silver halide photographic light-sensitive materials capable of being applied with the techniques of the invention, any of the silver halide photographic light-sensitive materials such as color printing paper, black-and-white printing paper, color reversal printing paper, color positive film, color negative film, black-and-white negative film, color reversal film, black-and-white reversal film, X-ray film, microfilm, film for copying use, direct-positive paper, film for graphic acts use, gravure film, light-sensitive material for diffusion-photographic use, and the like.

In the case that a light-sensitive material to be applied with the techniques of the invention is one for color photographic use, such light-sensitive materials are preferably those containing a magenta coupler having the formula [I] described in Japanese patent Application No. 94560/1984 applied by the present applicant, and particularly in the case of processing a light-sensitive material containing the described magenta coupler, it is desired that the compounds relating to the invention are selected from the group consisting of the above-mentioned (A) to (C) and particularly from (A).

[EXAMPLE]

The invention will now be described in more detail with reference to the following examples. It is, however, to be understood that the invention shall not be limited thereto.

EXAMPLE 1

An example of color printing paper was produced by the inventors in an ordinary procedure. The silver halide used therein was silver chlorobromide of which silver chloride was in the amount of 10 mol %. A sheet of polyethylene coated paper was coated therewith so that the silver amount coated may be 11 mg per 100 sq. cm, and was then dried up to prepare the sample. The sample was exposed to light by making use of a color-printer and was then processed in accordance with the following steps:

| Processing Steps | | |
|---|---|---|
| (1) Color developing | 33° C. | 3 min. 30 sec. |
| (2) Bleaching-fixing | 33° C. | 1 min. 30 sec. |
| (3) Stabilizing | 25 to 33° C. | 3 min. |
| (4) Drying | 75 to 80° C. | 2 min. approx. |

| Composition of Processing Liquid | |
|---|---|
| <Color Developer> | |
| Benzyl alcohol | 15 ml |
| Ethylene glycol | 15 ml |
| Potassium sulfite | 2.0 g |
| Potassium bromide | 0.3 g |
| Sodium chloride | 0.2 g |
| Potassium carbonate | 30.0 g |
| Hydroxylamine sulfate | 3.0 g |
| 1-hydroxyethylidene-1,1-diphosphonic acid (60% aqueous solution) | 1.0 g |
| Magnesium chloride | 0.9 g |
| 3-methyl-4-amino-N—ethyl-N—(β-methanesulfonamide ethyl)-aniline sulfate | 5.5 g |
| Optical brightening agent (Keikol, PK-C, mfd. by Shin Nisso Kako Co., Japan) | 1.0 g |
| Add water to make | 1,000 c.c. |
| Adjust pH by adding potassium hydroxide to | pH 10.20 |
| <Bleaching-fixing Liquid> | |
| Ammonium ethylenediamine tetraacetate iron(II) dihydrate | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Add water to make | 1,000 c.c. |
| Adjust pH by adding potassium carbonate to | pH 7.10 |
| <Stabilizing Liquid> | |
| Sodium benzoate | 0.5 g |
| 1-hydroxyethylidene-1,1-diphosphonic acid | 1.0 g |
| Magnesium chloride | 0.7 g |
| Polyvinyl pyrrolidone | 0.1 g |
| Ammonium hydroxide (28% aqueous solution) | 3 g |
| Adjust pH with acetic acid and potassium hydroxide to | pH 7.1 |

500 sheets of printing paper in size of 198cm$^2$ per liter were continuously processed. After the processing was completed, the stabilizing liquid was divided into 20 parts whereto the compounds shown in Table 1 were added. The pH values of the resulted solutions were adjusted to 7.1 in the aforementioned method, and 300 ml of each of the solutions were poured in an open glass-beaker having a capacity of 500 ml and were then preserved at the temperature of 38° C. with replenishing water to compensate an amount of each liquid reduced by evaporation. The preservation thereof were made with keeping watch over when a precipitation took place, and dates at which the liquids became completely turbid were recorded as the precipitated dates. The days up to the precipitated dates are shown in Table 1.

TABLE 1

| No. | Formula and compound added | Amount added (g/l) | Days of producing precipitation |
|---|---|---|---|
| Comparative sample | | | |
| 1 | Stabilizer without adding any compound | 0 | 10 days |
| 2 | 2-(4-thiazolyl)benzimidazole | 0.1 | 7 days |
| 3 | Sodium pentachlorophenol | 0.1 | 8 days |
| 4 | 2,6-dimethoxyphenol | 0.1 | 11 days |
| 5 | 2-nitro-1,3-propanediol | 0.1 | 9 days |
| 6 | 2-nitro-2-bromo-1,3-propanediol | 0.1 | 7 days |
| 7 | 1,3,5-triacryloylhexahydrotriazine | 0.1 | 10 days |
| 8 | 5-chloro-2-methyl-4-isothiazoline-3-one | 0.1 | 20 days |
| 9 | 1,2-benzisothiazoline-3-one | 0.1 | 16 days |
| Sample of the Invention | | | |
| 10 | Dodecylguanidine chloride | 0.1 | 65 days |
| 11 | Polyhexamethylene guanidine chloride | 0.1 | 67 days |
| 12 | 4-(2-nitrobutyl)morpholine | 0.1 | 58 days |
| 13 | 4-(3-nitrobutyl)morpholine | 0.1 | 57 days |
| 14 | Methylbenzimidazole carbamate | 0.1 | 41 days |
| 15 | Methyl-1-(butylcarbamoyl)-2-benzimidazole carbamate | 0.1 | 44 days |
| 16 | Tri-n-butyltetradecylphosphonium chloride | 0.1 | 53 days |
| 17 | 2-thiomethyl-4-ethylamino-6-(1,2-dimethylpropylamino)-s-triazine | 0.1 | 43 days |
| 18 | Hexahydro-1,3,5-tris(2-hydroxyethyl)-s-triazine | 0.1 | 44 days |
| 19 | Trioctylmethyl ammonium chloride | 0.1 | 42 days |
| 20 | 1-amino-3-isooxazolidone | 0.1 | 43 days |

As is obvious from Table 1, there is not any black precipitation caused at all in the process No. 1 carried out with a fresh stabilizing liquid which has not ever been used in any practical process. On the other hand, in the case of any one of the processes No. 2 through No. 9 carried out with a used stabilizing liquid added with a comparative compound that resembles the compounds of the invention and is well-known as a bacteriocide, it can be found that such a black precipitation is caused before it passes 20 days. In the case of any one of the processes No. 10 through No. 20 carried out with a stabilizing liquid comprising a used stabilizing liquid added with a compound of the invention, it is found that any black precipitation can be prevented for the period of not less than 30 days.

EXAMPLE 2

In this example, the stabilizing liquid of Example 1 was replaced by plain water and no water was replenished. Then, a continuous processing was carried out as in Example 1, for processing up to 500 sheets of printing paper in size of 198 sq. cm per liter. By making use of this processed washing water, the precipitation prevention effect was observed in exactly the same manner as that used in Example 1. The results thereof were that the same effects as that of Example 1 were obtained and the black precipitation was inhibited from occurring by the compounds of the invention for the period of about a month.

EXAMPLE 3

In this example, the stabilizing liquid No. 1 of Example 1, that was a fresh one, was added with a processed bleaching-fixing liquid obtained from an practical development process. With changing the amounts of the bleaching-fixing liquid added, each of the silver ion concentration in the stabilizing liquid was measured, and the results thereof are shown in Table 2.

The stabilizing liquids were preserved in the similar manner to that in Example 1, and the precipitation caused therein were observed.

As for the compounds added therein, there used 2-nitro-1,3-propanediol for the comparative examples and tri-n-butyltetradecyl phosphonium chloride for the compound of the invention, respectively.

TABLE 2

| silver ion concentration (mg/l) | Compound added Amount added: 0.1 g/l) | Days of producing precipitation |
|---|---|---|
| Comparative Example | | |
| 0 | 2-nitro-1,3-propanediol | Not produced for 30 days on longer |
| 5.4 | | Not produced for 30 days on longer |
| 16.1 | | 24 days |
| 32.0 | | 14 days |
| 120 | | 8 days |
| 532 | | 8 days |
| Example of the Invention | | |
| 0 | Tri-n-butyltetra decylphosphonium chloride | Not produced for 30 days on longer |
| 5.4 | | Not produced for 30 days on longer |
| 16.1 | | Not produced for 30 days on longer |
| 32.0 | | Not produced for 30 days on longer |
| 120 | | Not produced for 30 days on longer |
| 532 | | Not produced for 30 days on longer |

As may be understood from Table 2, it is found that a precipitation can hardly be caused when a silver ion concentration is substantially low even if no compound of the invention is contained, and that the effects of the invention are also substantially less in such a range as shown in the table.

I claim:

1. A method of processing an imagewise exposed silver halide photographic light-sensitive material characterized in that said material is developed and then processed with a first liquid capable of fixing and is, in succession, processed with a second liquid capable of stabilizing, without applying any intervening washing step, and containing at least one of the following compounds:

(A) a substituted or unsubstituted guanidine compound represented by

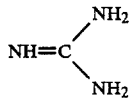

(B) a morpholine compound;

(C) a substituted or unsubstituted 2-carbonyl-aminobenzimidazole;

(D) A quaternary onium salt compound;

(E) a triazine compound represented by the following Formula (1) or (2)

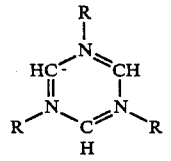

(1)

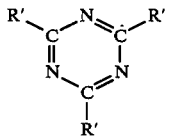

(2)

wherein R is an alkyl group and R′ is a halogen, amino group, alkyl group, or thioether group; or (F) an oxazolone compound containing at least one each of N, O, and C═O in the five-membered ring thereof;

and wherein a ratio of a volume of said first liquid to a volume of said second liquid is not less than 1/2,000.

2. The method of processing an imagewise exposed silver halide photographic light-sensitive material as claimed in claim 1, wherein said processing liquid capable of fixing contains a thiosulfate.

3. The method of processing an imagewise exposed silver halide photographic light-sensitive material as claimed in claim 1, wherein said stabilized liquid contains at least one kind of the following compounds:

(A) A guanidine compound, (B) A morpholine compound, and (D) A quaternary onium salt compound.

4. The method of processing an imagewise exposed silver halide photographic light-sensitive material as claimed in claim 1, wherein said quaternary onium salt compound is a quaternary phosphonium compound.

5. The method of processing an imagewise exposed silver halide photographic light-sensitive material as claimed in claim 1 wherein a multistage stabilizing tank counter-flow system is used comprising a plurality of individual stabilizing tanks.

6. The method of processing an imagewise exposed silver halide photographic light-sensitive material as claimed in claim 1, wherein the concentration of silver ions in said stabilizing liquid is not less than 20 mg per liter of said stabilizing liquid.

7. The method of processing an imagewise exposed silver halide photographic light-sensitive material as claimed in claim 1, wherein the concentration of silver ions in said stabilizing liquid is 20 mg per liter of said stabilizing liquid.

* * * * *